US008915371B2

(12) United States Patent
Giocastro

(10) Patent No.: US 8,915,371 B2
(45) Date of Patent: Dec. 23, 2014

(54) DUAL COMPARTMENT DISPENSER

(71) Applicant: James Giocastro, Valley Stream, NY (US)

(72) Inventor: James Giocastro, Valley Stream, NY (US)

( * ) Notice: Subject to any disclaimer, the term of this patent is extended or adjusted under 35 U.S.C. 154(b) by 60 days.

(21) Appl. No.: 13/910,000

(22) Filed: Jun. 4, 2013

(65) Prior Publication Data

US 2013/0263424 A1 Oct. 10, 2013

Related U.S. Application Data

(63) Continuation-in-part of application No. 13/066,480, filed on Apr. 15, 2011, now abandoned.

(60) Provisional application No. 61/395,447, filed on May 12, 2010, provisional application No. 61/384,370, filed on Sep. 20, 2010.

(51) Int. Cl.
*B65D 83/04* (2006.01)
*B65D 51/28* (2006.01)

(52) U.S. Cl.
CPC ..... *B65D 83/04* (2013.01); *B65D 51/28* (2013.01); *B65D 2313/04* (2013.01)
USPC ..... 206/538; 220/23.87; 220/522

(58) Field of Classification Search
USPC ..... 220/23.87, 23.83, 522, 521, 737; 206/538, 528, 540, 219; 215/6, 227
See application file for complete search history.

(56) References Cited

U.S. PATENT DOCUMENTS

| | | | | | |
|---|---|---|---|---|---|
| 2,317,882 | A | * | 4/1943 | Boesel | 96/148 |
| 2,559,168 | A | * | 7/1951 | Numbers | 141/381 |
| 2,941,689 | A | * | 6/1960 | Black | 220/522 |
| 3,433,378 | A | * | 3/1969 | Ross | 215/6 |
| 3,840,136 | A | * | 10/1974 | Lanfranconi et al. | 215/6 |
| 4,475,654 | A | * | 10/1984 | Fruchter | 206/538 |
| 4,618,444 | A | * | 10/1986 | Hudson et al. | 8/111 |
| 4,636,328 | A | * | 1/1987 | Flynn et al. | 510/277 |
| 4,667,818 | A | * | 5/1987 | Evans | 206/219 |
| 4,720,351 | A | * | 1/1988 | Flynn et al. | 510/277 |
| 4,776,972 | A | * | 10/1988 | Barrett | 252/186.38 |
| 5,318,183 | A | * | 6/1994 | Cohen et al. | 206/538 |
| 5,383,579 | A | * | 1/1995 | Lanfranconi et al. | 222/129 |
| 5,439,103 | A | * | 8/1995 | Howes | 206/217 |
| 5,950,819 | A | * | 9/1999 | Sellars | 206/221 |

(Continued)

*Primary Examiner* — Steven A. Reynolds
(74) *Attorney, Agent, or Firm* — Alfred M Walker; Ellen Hollcroft

(57) ABSTRACT

A dual compartment dispenser for pill or other item storage includes a larger outer compartment container and an auxiliary smaller pocket container configured to accommodate a predetermined daily dosage of items, which the user can carry in a clothing pocket, backpack or handbag, without having to carry the entire bottle container of items. The smaller auxiliary pocket container compartment nests on an interior collar ledge within the outer compartment container It is loosely supported by a ledge within the neck of a bottle neck container. The daily dose container gyrates and pivots upward when pushed against on one side of a top edge thereof, so that the daily dose container is up-ended and provides a portion extending upward above a top of the neck of the main housing container housing, for manual grasping without the need to invert the main housing container to release the smaller auxiliary pocket container therefrom.

6 Claims, 8 Drawing Sheets

(56) References Cited

U.S. PATENT DOCUMENTS

| | | | | |
|---|---|---|---|---|
| 6,062,441 | A * | 5/2000 | Mengeu et al. | 222/521 |
| 6,386,358 | B1 * | 5/2002 | North et al. | 206/217 |
| 6,386,367 | B1 * | 5/2002 | Bayliss, IV | 206/534 |
| 7,055,709 | B1 * | 6/2006 | Esau | 215/228 |
| 8,328,032 | B2 * | 12/2012 | Gong | 215/227 |
| 2008/0011624 | A1 * | 1/2008 | Robb et al. | 206/219 |
| 2009/0050514 | A1 * | 2/2009 | Devaux-Day | 206/538 |
| 2009/0159544 | A1 * | 6/2009 | Tune | 211/153 |

* cited by examiner

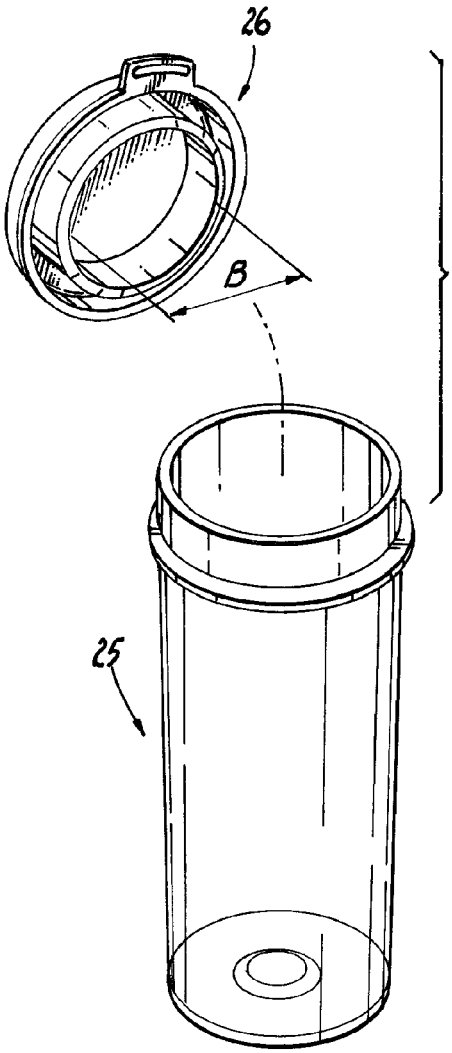
Fig. 6
(Prior Art)
Fig. 7
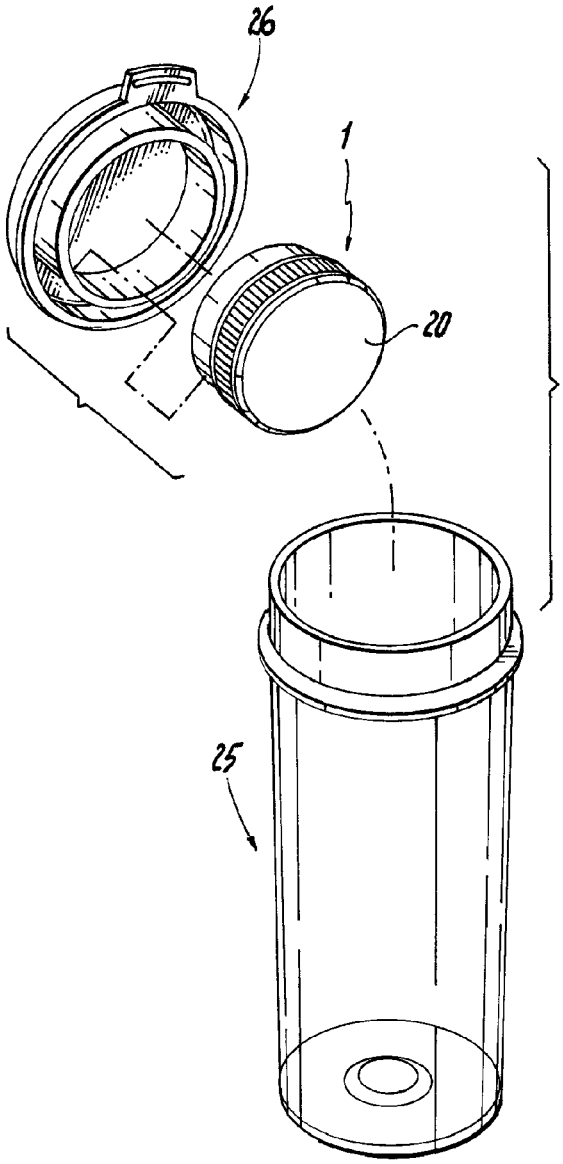

DUAL COMPARTMENT DISPENSER

RELATED APPLICATIONS

This application is a continuation-in-part of application Ser. No. 13/066,480, filed Apr. 15, 2011, from which Applicant claims priority under 35 U.S.C. 120, and which application is based upon, and claims priority under 35 U.S.C. 119(e) from provisional application No. 61/395,447 filed May 12, 2010 and provisional application No. 61/384,370 filed Sep. 20, 2010. These three applications are incorporated by reference herein.

FIELD OF THE INVENTION

The present disclosure is directed to a dual compartment dispenser for storage of prescription or non-prescription medicine, pills, capsules, tablets, supplements, vitamins, etc.

OBJECTS OF THE INVENTION

It is an object of the present container to provide a convenient dual compartment dispenser for storage of prescription or non-prescription medicine or supplements in the form of pills, capsules, tablets, caplets, or other items, wherein a smaller auxiliary pocket daily dose container is provided with the overall larger container, to enable a user to carry a single daily dosage of these items within a pocket of an article of clothing or in a handbag or other personal storage device, such as a backpack or belt pack.

It is another object of the present invention to support an auxiliary daily dosage container within the confines of a larger dispenser container.

It is yet another object of the present invention to provide a kit for carrying a daily dosage of prescription or non-prescription medicine, vitamins or other supplements.

Other objects will become apparent from the following description of the present invention.

SUMMARY OF THE INVENTION

In keeping with these objects and others which may become apparent, the present invention is a dual compartment dispenser for storage of prescription or non-prescription items in which one of the compartments is an auxiliary smaller pocket daily dose container configured to accommodate a predetermined daily dosage of pills, tablets, capsules or prescription or non-prescription medicine, supplements, vitamins or other daily dosage items which the use can carry in a clothing pocket, backpack or handbag, without having to carry the entire bottle container of pills, tablets, capsules or other daily dosage items. For example if a pharmaceutical prescription prescribes a dosage of four pills or other items per day, the smaller compartment can hold a daily dosage of four pills or other items. Likewise, if the dosage is two per day, the smaller compartment can hold the daily dosage of two pill or other items.

The smaller auxiliary pocket container compartment fits underneath the cap of the main housing container compartment, or optionally is held in place within to the inner collar neck of the container, or to an underside or top side of the cap of the container. The smaller auxiliary pocket container compartment can be held in place by threaded engagement, by a friction fit with or without a detent and/or ledge supporting the smaller auxiliary pocket daily dose container compartment, or by magnets or other adhesive methods inside, or on top of, the cap. The daily dose container can also be supported loosely upon a shoulder ledge inside the neck of a bottle neck container.

The dual compartment dispenser of the present invention enhances a medicine or other vitamin/supplement dispenser container by enabling the user to conveniently carry a daily dose of items in the daytime, while being able to store the smaller auxiliary pocket container compartment within the outer larger compartment container at night between daily dosages.

The smaller container also acts as a reminder so that when empty, the user knows to refill the small container with a daily dose of items for the next day. Preferably, a portion of the smaller container is transparent to reveal to the user the presence or absence of the daily dose of items, or portions thereof, within the smaller container.

In an alternate embodiment, the smaller auxiliary pocket container compartment can be nested within a carry well fitted with an adhesive backing, so that it can be sold with a carry well which is adherable to a surface of a cap for a container holding medicine or other supplements.

The small container can then be held within the carry well in a "well and pot" relationship by various attachment methods, such as by threaded means, friction fit, magnetic or other mechanical grasping means.

The carry well can also be magnetically attached to a surface of a medicine or other supplement container cap. It can be provided and sold in a transparent package attached to the flat top of a pill dispenser container. In this embodiment, the small container can be moved to different carry wells, which are adhesively or magnetically attached to a surface of various medicine container caps.

In an alternate embodiment, the smaller auxiliary pocket container is cylindrically shaped, with rounded top and bottom edges, which nest upon an interior rounded circumferential ledge with a slightly descending top edge of a main housing container, upon which the smaller auxiliary pocket container gyrates and therefore pivots upward when pushed against on one side, so that the smaller auxiliary pocket container is up-ended and provides a portion extending upward above the top of the neck of the main container compartment, for manual grasping without the need to invert the main container compartment to release the smaller auxiliary pocket container therefrom.

In general, the dual compartment dispenser can be used as a method of reminding users of daily dosage of pills, including the steps of a) providing a first container having a supply of prescription or nonprescription medicine or supplements therein;
b) providing a cap for closing said first container;
c) providing a smaller container attachable to said cap or said first container;
d) providing a daily dose of said prescription or nonprescription medicine or supplements within second container;
e) providing a portion of said second container with a transparent portion for viewing whether said daily dose has been consumed or not,
f) wherein the smaller second container is removable from the larger first container, to be carried in the pocket or purse of the user, while the first container is covered by the cap.

BRIEF DESCRIPTION OF DRAWINGS

The present invention can best be understood in connection with the accompanying drawings. It is noted that the invention is not limited to the precise embodiments shown in drawings. Various embodiments of the present disclosure will be described herein below with reference to the figures wherein:

FIG. 6 is a perspective view of a large prescription or non-prescription medical or supplement item holding container with a push-on cap, as is available in the prior art.

FIG. 7 is an exploded perspective view showing a small daily dose container of the plain bottom type held, inside the cap of FIG. 6 by friction fit, and therefore inside the large container.

DETAILED DESCRIPTION

The daily dose containers of the dual compartment dispenser of this invention come in a variety of sizes and shapes and types. Three basic types are shown in FIGS. 1-3.

Figure 1:
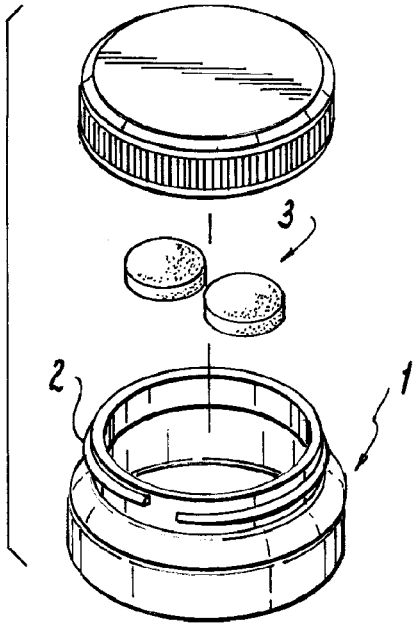
FIG. 1 is a perspective view of a small daily dose container of this invention with a plain bottom and topside external threads to receive a screw cap.

In FIG. 1, a small daily dose container 1 with a plain flat, optionally preferably transparent, bottom is shown with external threads 2 at the opening to receive a common screw cap, to hold items 3, such as medicine or supplements, such as pill, caplets, capsules etc therein.

Figure 2:
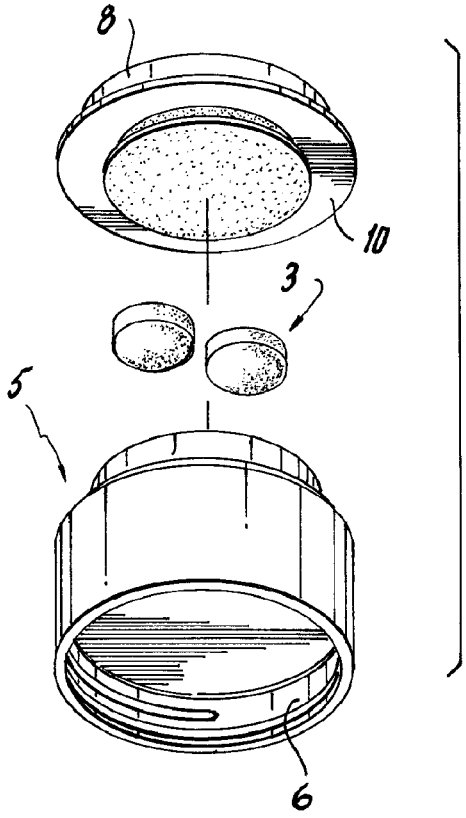
FIG. 2 is an exploded perspective view of a small daily dose container with internal threads in a recess on the bottom and a plain top to receive a push-on cap.
Figure 3:
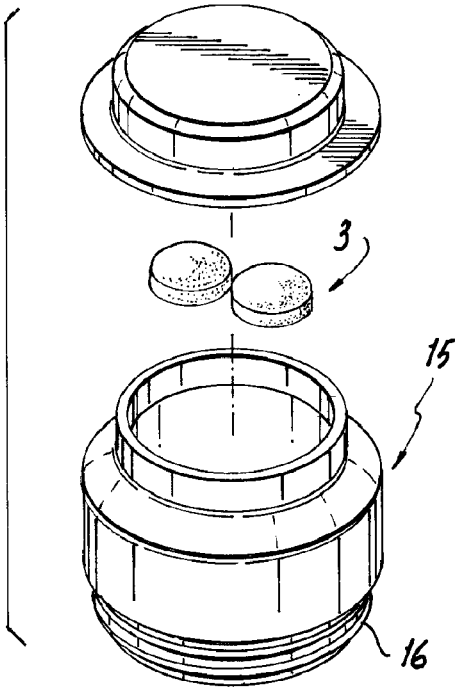
FIG. 3 is an exploded perspective view of a small daily dose container with external threads at the bottom.

FIG. 2 shows an alternate embodiment for a small daily dose container 5 with no threads around the opening, which is formed to receive a push-on cap 8 with optional flip extension 10. A bottom recess of small daily dose container 5 with internal threads 6 is also shown. Small daily dose container 15 shown as a further alternate embodiment in FIG. 3 has external threads 16 at the bottom end. Note that all other combinations such as a small daily dose container with a screw cap and either internal or external bottom threads, or a plain bottom container with a push-on cap, are also possible as desired. The daily dose configuration used would be compatible with the attachment or support the method of the large medical or supplement item 3 holding container of the dual compartment dispenser.

Figure 4:
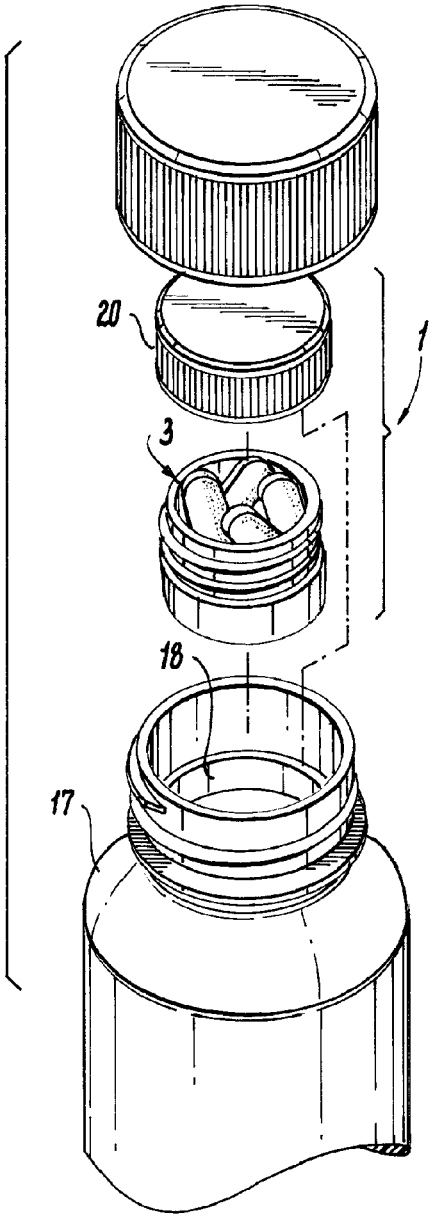
FIG. 4 is a perspective detail of a large prescription or non-prescription medical or supplement item container in the form of a bottle with a collar installed in the neck to act as a resting ridge for a small daily dose container.
Figure 5:
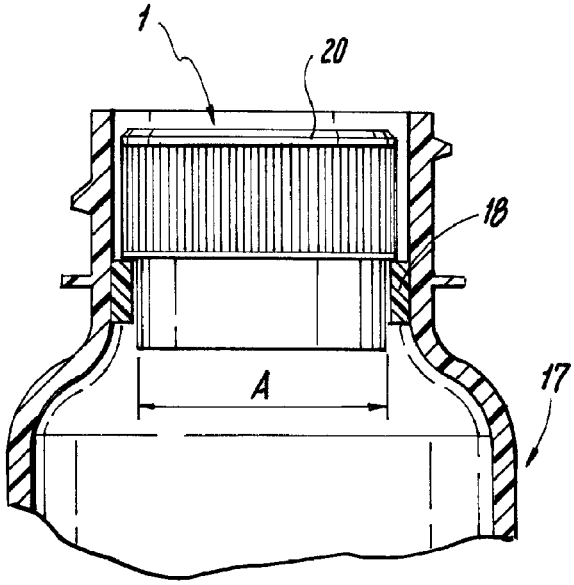
FIG. 5 is an exploded perspective view in partial crossection showing the small daily dose container resting on the collar of the embodiment of FIG. 4.

FIGS. 4 and 5 relate to the use of a small daily dose container with a pill 3 or other item 3 holding bottle 17 having a neck. In FIG. 4 bottle 17 has a circular collar 18 fitted inside the neck providing a rest area to support by gravity the small daily dose container 1 by the bottom edge of its cap 20. This is shown in FIG. 5. Note that the diameter A of small daily dose container 1 is less than the inside diameter of collar 18 to provide a loose gravity fit. The cap of pill 3 or other item 3 holding bottle 17 (not shown) secures cap 20 between its inside top surface and collar 18. The small daily dose container 1 readily falls out if the pill bottle is uncapped and inverted past 90 degrees.

FIG. 6 shows a common type pill 3 or other medical or supplement item 3 holding container 25, with its push-on cap 26 having a central underside recess with diameter B. Cap 26 is made of a plastic with a limited amount of resiliency and a rubbery feel. The side crossection of FIG. 7 shows how small daily dose container 1 is held by friction fit (inverted inside pill 3 or other prescription or non-prescription medical or supplement item 3 holding container 25) since the outer diameter of container 1 is an interference fit inside resilient cap 26.

Figure 8:
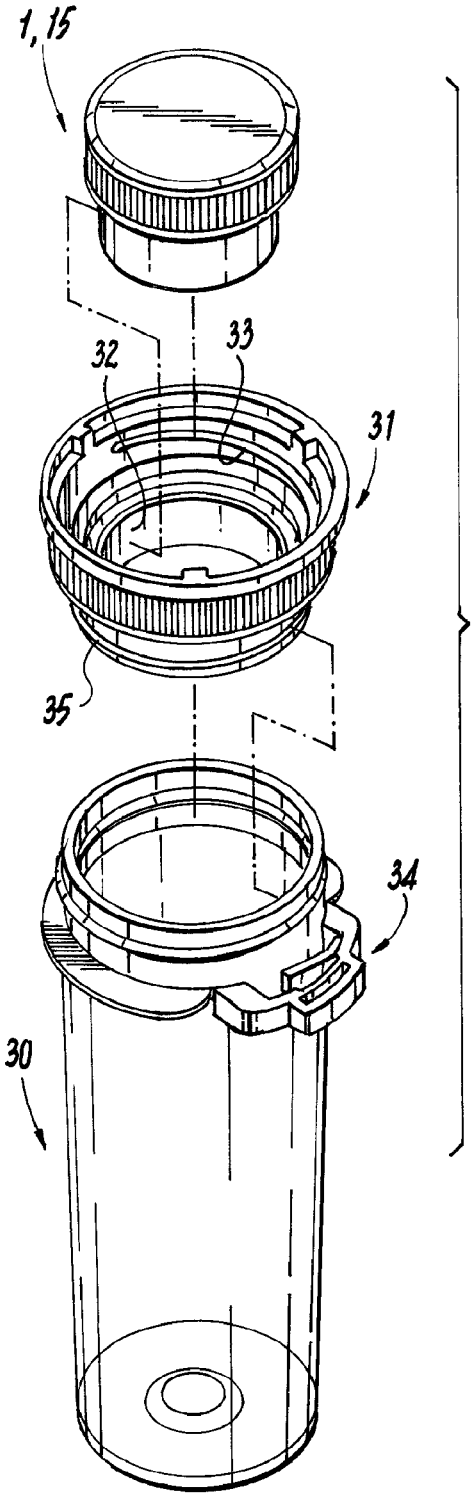
FIG. 8 is a an exploded perspective view of the top of a medical or supplement item holding container with a small daily dose container on top attached to a convertible closure in the non-secure configuration.
Figure 9:
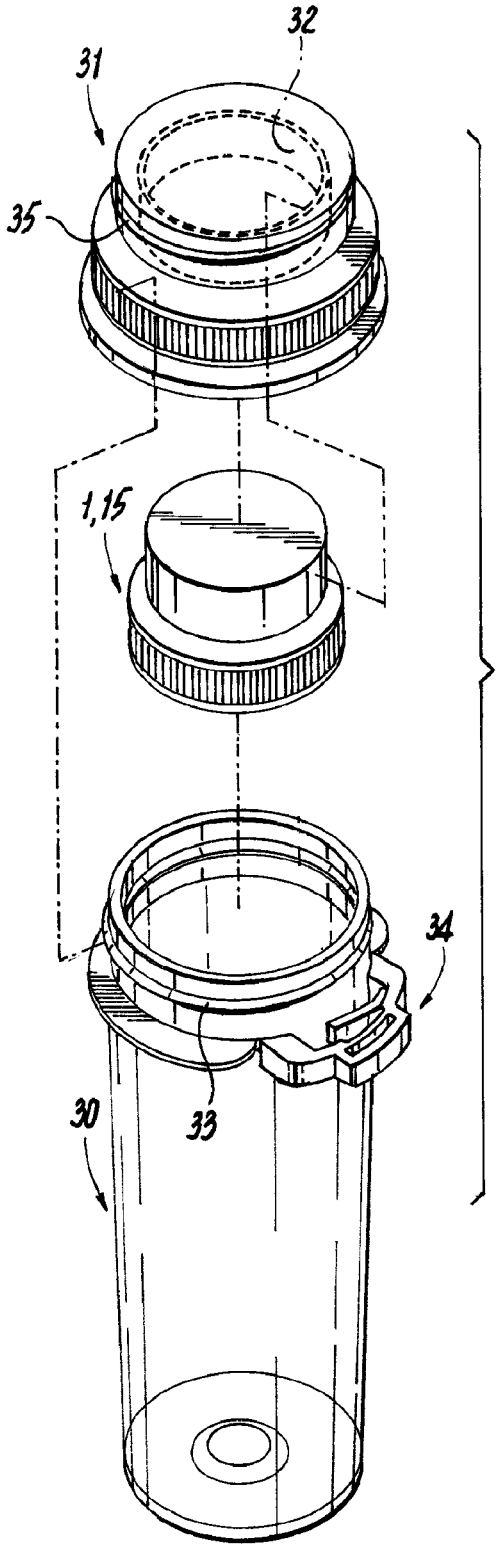
FIG. 9 is an exploded perspective view of the cap of FIG. 8 in the secure configuration holding the small daily dose container within the larger medical or supplement item holding container.

FIGS. 8 and 9 illustrate how a modified convertible safety cap can be used to hold a daily dose container either on a top side or underside of the safety cap. FIG. 8 shows container 30 capped by cap 31 in the non-safety configuration using external threads 35 (see FIG. 9) mating with internal threads on the inside surface of container 30. Cap 31, in this mode bypasses the safety engagement extension 34 and can be simply unscrewed. Cap 31 is modified by the addition of collar 32 which forms a recess around the bottom of a daily dose container. It can hold the daily dose container by friction fit if the collar is slightly resilient and a container of type 1 of FIG. 1 with a plain bottom is used. Alternately, the collar 32 can have internal threads which would mate with a daily dose container of type 15 in FIG. 3. (Male threads on a circular boss instead of a collar 32 can also mate with a small daily dose container of type 5 with bottom internal threads; this has not been shown.) Note that in this configuration, small daily dose container 1 or 15 would be attached on top of cap 31.

FIG. 9 shows the situation in the safety configuration of cap 31 wherein it engages the external threads on container 30 via the internal threads 33 shown in FIG. 8. It also engages safety extension 34. In this configuration, as seen in the phantom view the friction fit, daily dose container 1, or threaded daily dose container 15, is inverted inside container 30.

Figure 10:
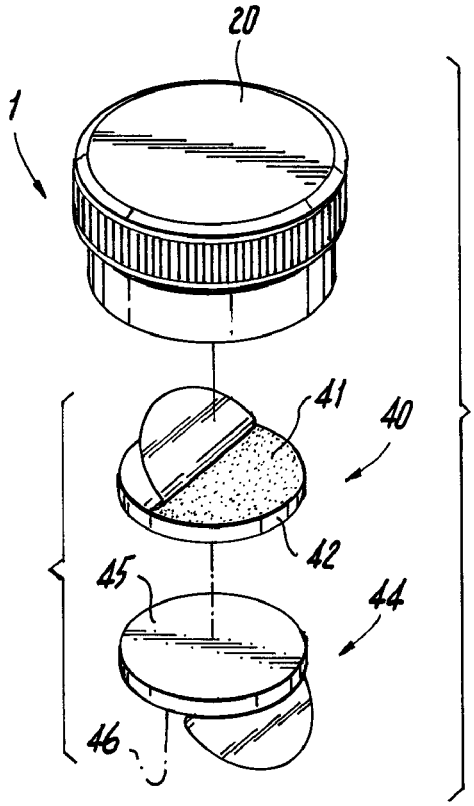
FIG. 10 is an exploded perspective view of the three parts of a kit for magnetic attachment of a small daily dose container to either the inside or outside surface of a container cap of a larger prescription or non-prescription medical or supplement item holding container.
Figure 11:
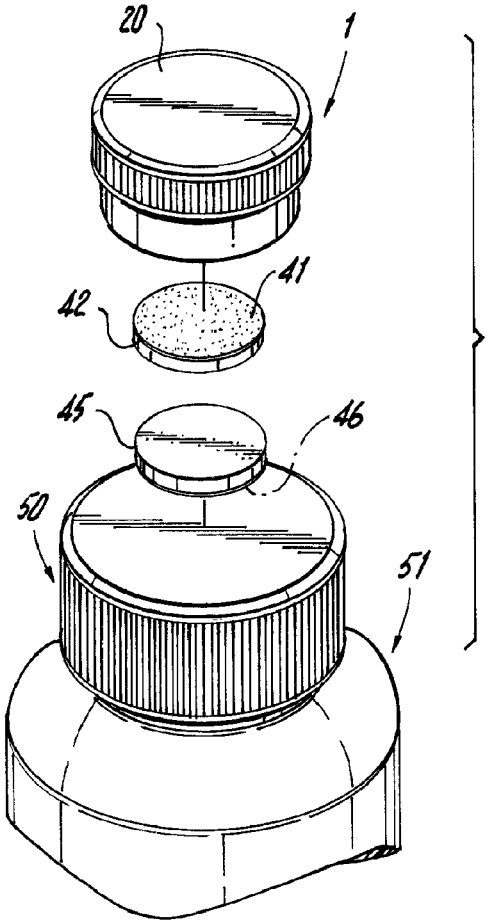
FIG. 11 is a an exploded perspective view showing the magnetic attachment of a small daily dose container to the top surface of a larger prescription or non-prescription medical or supplement item holding container.
Figure 12:
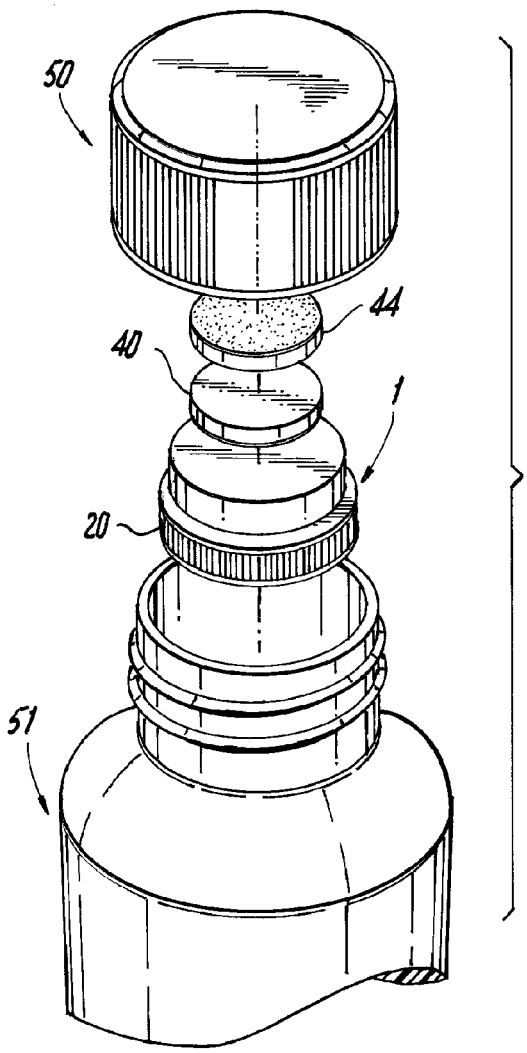
FIG. 12 is an exploded perspective view showing the magnetic attachment of the small daily dose container to the underside of the container cap as in FIG. 11.

FIGS. 10-12 show details of a magnetic attachment method for a small daily dose container of the dual compartment dispenser of this invention to the top or bottom side of any container cap of appropriate size. The intention is to offer this embodiment as a kit so that the consumer can prepare the container cap of the larger medical or supplement item 3 holding container to attach to the small daily dose container magnetically.

In FIG. 10 an exploded view of the three major parts is shown. Daily dose container 1 with a flat bottom is one part of the kit. The next item is a magnet subsystem 40 including disk magnet 42 with a layer of pressure sensitive adhesive 41 attached and covered with a release liner. After the release liner is released, exposing adhesive layer 41, magnet 42 is attached to the bottom of small daily does container 1. (This step can be performed at the factory so that the kit may be only two parts.) A ferromagnetic disk assembly 44 includes a painted or plated steel disk 45 and a bottom adhesive layer 46 covered by a release liner. Disk 45 is then attached to the top or bottom of the container cap as desired.

FIGS. 11 and 12 show a side top detail of container 51 with cap 50. A top mount for the small daily dose container 1 is illustrated by FIG. 11, while an "inside the cap" attachment of the small daily dose container 1 is shown in FIG. 12. In either case, the small daily dose container 1 is removably attached by magnetic attraction. If desired, extra disk assemblies 44 can be provided in the kit so that the small daily dose container 1 can be attached to a variety of containers, or in case the prescription bottle type is changed so that the enhanced cap can no longer be used on the new prescription refill.

Alternately, to avoid carrying a magnetized daily dose container in a pocket or purse having credit cards sensitive to magnets, the system could be reversed, so that the daily dose container has a non-magnetic ferro magnetic disk or layer (such as a painted or plated steel disk), and the respective cap of the larger compartment container (such as a pill bottle or a medicine jar) can have the disk magnet attachable thereto. For use with the multiple items in multiple larger containers, each larger container can have a magnet attached thereto.

Figure 13:
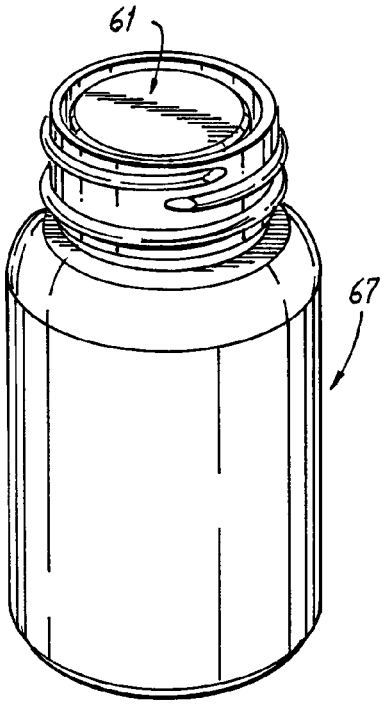
FIG. 13 is a perspective view of an alternate embodiment for a main housing container with an interior compartment with a neck having a circular collar ledge for nesting a small rounded cylindrical daily dose pocket container thereon.
Figure 14:
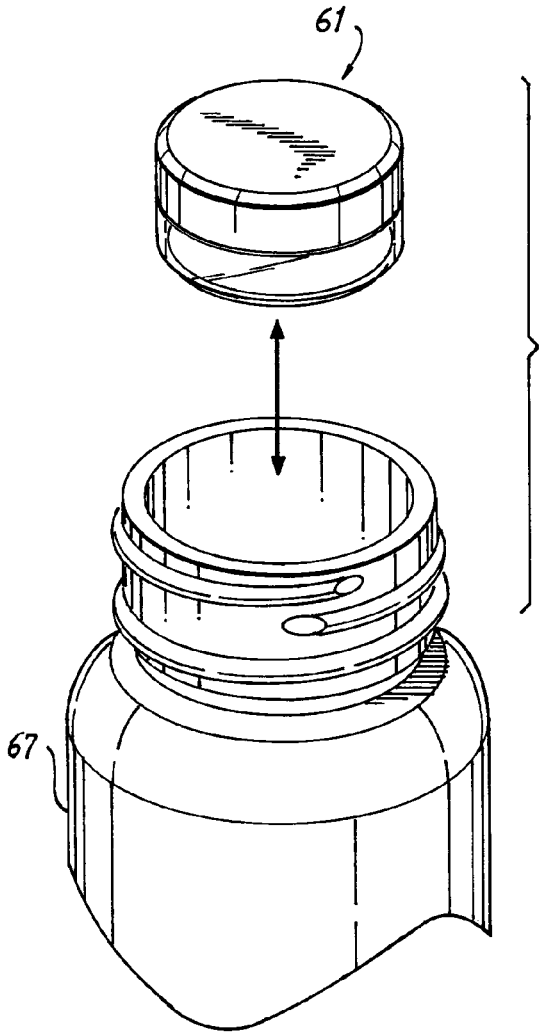
FIG. 14 is a close up detail view of the alternate embodiment of FIG. 13 showing the small rounded cylindrical daily dose pocket container prior to insertion within the neck of the main housing container.
Figure 15:
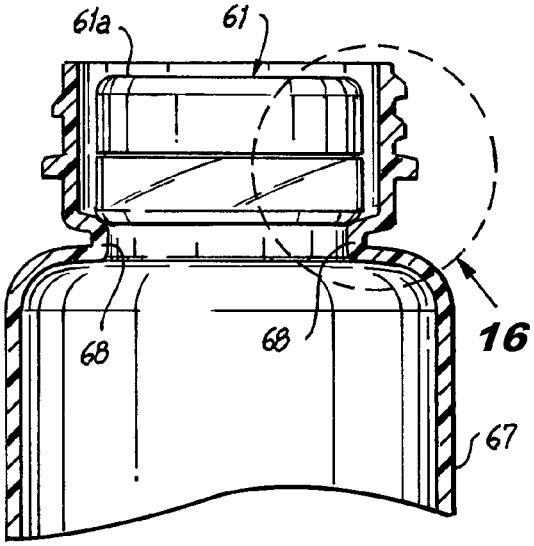
FIG. 15 is a crossectional view of the main housing container showing a circular collar ledge with descending rounded edges supporting the cylindrical daily dose pocket container of FIG. 14 thereon.
Figure 16:
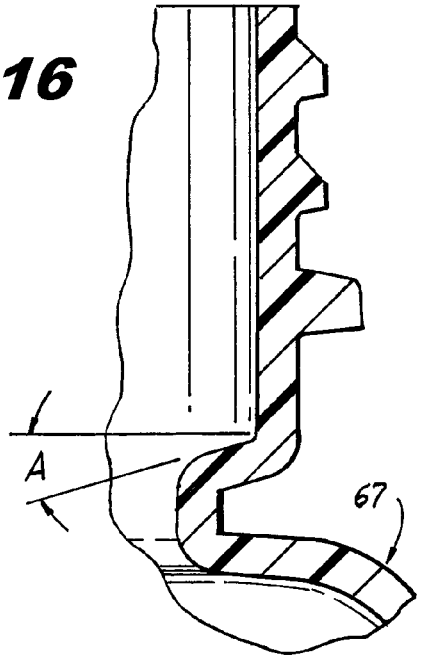
FIG. 16 is a close-up detail view taken along circular viewing circle "16" of FIG. 13.
Figure 17:
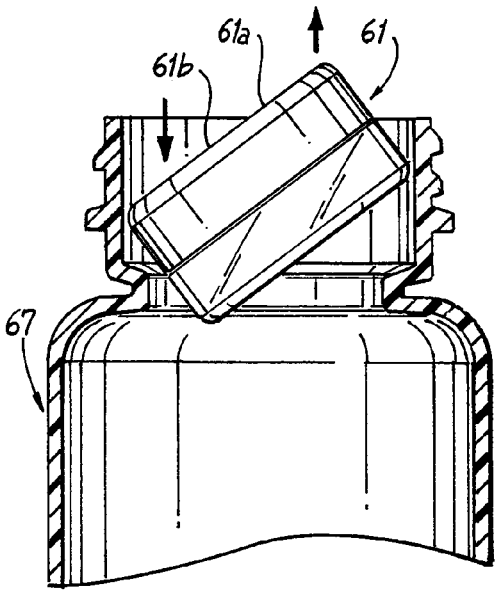
FIG. 17 is a side elevational view of the embodiment of FIGS. 13-16, showing manual force being exerted upon one side of the small rounded cylindrical daily dose pocket container to cause gyration and pivoting upward in the direction of the arrow shown.
Figure 18:
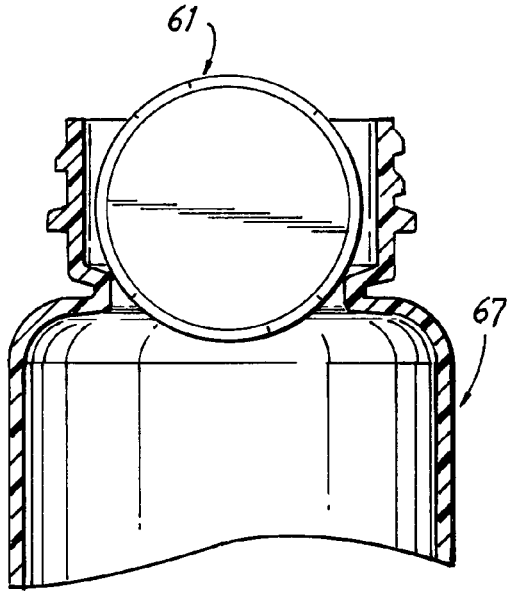
FIG. 18 is a side elevation view in crossection showing the small daily dose container inverted 90 degrees after gyration for manual grasping and removal from the neck of the open main housing container.

FIGS. 13 and 14 are a further alternate embodiment similar to the embodiment of FIGS. 4 and 5 with the interior ledge. However, in FIGS. 13 and 14, in an alternate embodiment, the smaller auxiliary daily dose pocket container 61 is cylindrically shaped, with rounded top and bottom edges, which nest upon an interior rounded open circular collar ledge 68 of an interior compartment neck 69 of main housing container 67. Interior collar ledge 68 has a slightly descending top edge 68*a*, which descends preferably downward at an angle "A" of about 15 degrees from the horizontal, upon which circular collar ledge 68 the smaller auxiliary daily dose pocket container 61 gyrates and pivots upward when pushed against on one side 61*b* of flat top 61*a*, so that the smaller auxiliary daily dose pocket container 61 is up-ended and provides a portion 61*c* extending upward above the top 69*a* of the neck 69 of the main housing container 67, for manual grasping without the need to invert the main housing container 67 to release the smaller auxiliary daily dose pocket container 61 therefrom. The smaller auxiliary daily dose pocket container contains a daily dose of one or more pills 3 or other items 3. Circular collar ledge 68 is fitted inside the neck 69 providing a rest area to support by gravity the smaller daily dose pocket container 61*b*. Note that the diameter of small daily dose pocket container 61 is more than the inside diameter of collar ledge 68 to provide a loose gravity fit. The small daily dose pocket container 61 gyrates and pivots upward up to 90 degrees, exposing 61*c* above the top of neck 69 of main housing container 67.

It is further noted that the foregoing descriptions are exemplary, so that other embodiments may be foreseen from the description of the Claims.

I claim:

1. A method of providing a dual compartment dispenser for medicine or supplements comprising the steps of:

providing a cylindrical main housing container with an interior compartment having an open top with a neck ledge collar formed below said open top containing an extended supply of prescription or non-prescription medical or supplement items;

providing an upper neck portion of said housing adjacent said open top having features to receive a closure;

providing a daily dose container having a shoulder resting within said neck on said collar, said daily dose container having a more limited supply of said prescription or non-prescription medical or supplement items;

providing a closure for closing said cylindrical housing thereby forming a single container in which a single dose of said prescription or non-prescription medical or supplement items may be conveniently be carried within said cylindrical housing in addition to a separate larger supply of said medical or supplement items; and, said daily dose container being cylindrically shaped having a flat circular top surface and a flat circular bottom surface, with rounded top and bottom edges, which nest upon an interior rounded circumferential ledge with a slightly descending top edge of said collar within said neck of said housing, upon which said daily dose container gyrates and pivots inverted 90 degrees upward when user manual force is pushed against on one side portion of a top edge thereof, so that said daily dose container is up-ended and provides an opposite side portion extending upward above a top of said neck of the main housing container housing, for manual grasping without the need to invert the main housing container to release said daily dose container therefrom.

2. The method as in claim 1 further comprising the step of providing a portion of said daily dose container with a transparent portion for viewing whether said daily dose has been consumed or not, wherein further said pivoting and rotation of said daily dose container reveals said transparent portion for said viewing whether said daily dose has been consumed or not;

wherein said daily dose container is not removable from said first container while said main housing container is covered by said closure.

3. A daily dose container comprising, in combination:

a cylindrical housing having a closed bottom and an open top containing one clay dosage supply of prescription or non-prescription medical or supplement items;

an upper portion of said housing having means adjacent said open top for receiving a cap, said cap having a downwardly facing shoulder extending out beyond an outer surface of said cylindrical housing;

a container having an extended supply of said prescription or non-prescription medical or supplement items;

said container having an upper neck portion with a top opening and a threadable cap for closing said container; and a circular collar fitted inside said upper neck portion providing a resting surface for said downwardly facing shoulder of said cap to support by gravity said housing whereby said housing containing said one day supply of said items is completely contained within said container when said threadable cap closes said upper neck portion of said container.

4. The daily dose container of claim 3 whereby a portion of said housing is transparent to reveal to a user the presence or absence of a daily dose of said items.

5. A dual compartment dispenser comprising:

a cylindrical housing with a first compartment having an open top with a neck ledge collar formed below said open top containing an extended supply of prescription or non-prescription medical or supplement items in the form of pills;

an upper neck portion of said housing adjacent said open top having features to receive a closure for said cylindrical housing;

said neck ledge collar located below said open top;

a daily dose container within said neck, said daily dose container containing a more limited supply of said prescription or non-prescription medical or supplement items;

said daily dose container being cylindrical with an open top having a threadable closure cap, said closure cap having an outer diameter larger than a diameter of said container and forming an annular shoulder surrounding said container;

said daily dose container within said neck of said housing being supported by gravity with said closure cap annular shoulder resting on said neck ledge collar; and a closure for closing said cylindrical housing thereby forming a single container in which a single dose of said prescription or non-prescription medical or supplement items may be conveniently be carried within said cylindrical housing in addition to a separate larger supply of said medical or supplement items.

6. The dual compartment dispenser of claim 5 whereby a portion of said container is transparent to reveal to a user the presence or absence of a daily dose of said items.

* * * * *